US006702187B2

(12) United States Patent
van der Merwe

(10) Patent No.: US 6,702,187 B2
(45) Date of Patent: Mar. 9, 2004

(54) AIR DIFFUSER

(75) Inventor: Gustav Johann van der Merwe, Strand (ZA)

(73) Assignee: Richard Air Diffusion (proprietary) Limited, Industrial Park Ottery (ZA)

( * ) Notice: Subject to any disclaimer, the term of this patent is extended or adjusted under 35 U.S.C. 154(b) by 0 days.

(21) Appl. No.: 10/287,094

(22) Filed: Nov. 4, 2002

(65) Prior Publication Data

US 2003/0087599 A1 May 8, 2003

(30) Foreign Application Priority Data

Nov. 6, 2001 (ZA) ..... 2001/9138

(51) Int. Cl.[7] ..... F24F 7/10
(52) U.S. Cl. ..... 236/49.5; 236/99 E; 236/100
(58) Field of Search ..... 236/49.5, 93 R, 236/91 E, 101 B, 99 E, 100

(56) References Cited

U.S. PATENT DOCUMENTS 4,155,504 A * 5/1979 Caldwell ..... 236/49.5
4,165,034 A * 8/1979 Rogers et al. ..... 236/12.2
4,491,270 A * 1/1985 Brand ..... 236/49.5
4,883,082 A * 11/1989 Pirkle ..... 137/62
5,647,532 A 7/1997 De Villiers et al. ..... 236/495
5,860,592 A * 1/1999 Dozier et al. ..... 236/49.3
6,176,435 B1 * 1/2001 Nielsen ..... 236/49.5
6,254,010 B1 7/2001 De Villiers ..... 236/49.5

* cited by examiner

*Primary Examiner*—William E. Tapolcai
(74) *Attorney, Agent, or Firm*—Ladas & Parry

(57) ABSTRACT

A diffuser (10) for controlling flow of air in an air conditioning system, the diffuser comprising two temperature sensitive elements (20, 22) for respectively sensing room temperature and duct temperature variations. The elements (20, 22) are axially aligned. Links (68) are provided for displacing an air flow control baffle (78). A control structure is provided for displacing the links (68) in dependence on sensed room temperature thereby to displace the baffle (68) and vary air flow. The control structure has two components (34, 36) which act on the links (68). When the element (22) is detecting cooled air the component (34) acts on the links (68). The component (36) acts on the links (68) when the element (22) is detecting warmed air. Switch over between these conditions occurs automatically as supply of air is changed from hot to cold and visa versa.

12 Claims, 17 Drawing Sheets

AIR DIFFUSER

FIELD OF THE INVENTION

THIS INVENTION relates to diffusers.

BACKGROUND TO THE INVENTION

The term "diffuser" is used to designate those devices which, in air conditioning systems, are employed for the purpose of regulating flow of air, which may be heated air or cooled air, from air conditioning ducting into a room.

Various conditions occur in an air conditioned room depending on whether the outside temperature is above that at which the room is to be maintained or below that at which the room is to be maintained.

In "Summer" conditions cooled air is fed from the air conditioning plant to the diffuser. If the room temperature is below that at which it is desired to maintain it, because cooled air has previously been fed in, then the diffuser must remain closed to prevent further cooled air entering the room.

As the room heats up a room temperature sensing element must detect this and open the diffuser to allow more cooled air into the room. The diffuser thus opens and closes as the room temperature varies.

In "Winter" conditions heated air is fed to the diffuser. If the room is above the requisite temperature, because heated air has previously been fed into the room, the diffuser must remain closed to prevent further heated air entering. As the room cools down, the room temperature sensing element must detect this and open the diffuser to allow more heated air in. The diffuser consequently opens and closes as the room temperature varies.

In the specification of our South African patent 96/4791 (U.S. Pat. No. 5,647,532 and Australian Patent No. 700908) there is disclosed a diffuser which has a single room temperature sensing element which closes a diffuser when the room is too cold (in Summer conditions) and also closes the diffuser when the room is too hot (in Winter conditions). This avoids the use of complex constructions involving two or more room temperature sensing elements. The present invention seeks to provide an improved diffuser using a single room temperature sensing element. A modification of this diffuser is disclosed in our South African Patent No. 2000/1891 (U.S. Pat. No. 6,254,010 and Australian Patent Application No.28880/00)

BRIEF DESCRIPTION OF THE INVENTION

According to one aspect of the present invention there is provided a diffuser for controlling flow of air in an air conditioning system, the diffuser including an air flow control baffle, a first temperature sensitive element for sensing room temperature variations and including a body and a piston which move relatively to one another in response to temperature variations, a second temperature sensitive element for sensing duct temperature variations and including a body and a piston which move relatively to one another in response to temperature variations, a housing, the body of one of said elements being fixed to said housing, a pair of links having inner ends and outer ends, the links being pivotally mounted on said housing at their inner ends and having their outer ends connected to said baffle, the links protruding outwardly from said housing, each link having a first cam surface on one side of its pivotal mounting and a second cam surface on the other side of its pivotal mounting, a control element having a first surface for bearing on said first cam surfaces and a second surface for bearing on said second cam surfaces, the body of the other temperature element being fast with said control element, spring means for urging said first surface towards the first cam surfaces, and a rod opposite ends of which bear on said pistons to prevent the pistons moving towards one another, the spring means, by acting on the body of said other element, holding the pistons against movement away from the ends of the rod.

According to a further aspect of the present invention there is provided a diffuser for controlling flow of air in an air conditioning system, the diffuser comprising first and second temperature sensitive elements for respectively sensing room temperature and duct temperature variations, the elements being axially aligned, a link for displacing an air flow control baffle, and a control structure for displacing said link in dependence on sensed room temperature thereby to displace said baffle and vary air flow, said control structure having a first component which acts on the link when said second element is detecting cooled air and a second component which acts on the link when the second element is detecting warmed air.

According to another aspect of the present invention there is provided a diffuser for controlling flow of air in an air conditioning system, the diffuser including an air flow control baffle, a first temperature sensitive element for sensing room temperature variations and including a body and a piston which move relatively to one another in response to temperature variations, a second temperature sensitive element for sensing duct temperature variations and including a body and a piston which move relatively to one another in response to temperature variations, a housing, the body of the first element being fixed to said housing, a pair of links having inner ends and outer ends, the links being pivotally mounted on said housing at their inner ends and having their outer ends connected to said baffle, the links protruding in opposite directions to one another from said housing, each link having a first cam surface on one side of its pivotal mounting and a second cam surface on the other side of its pivotal mounting, a control element having a first upwardly facing surface for bearing on said second cam surfaces and a second downwardly facing surface for bearing on said first cam surfaces, the body of the first temperature element being fast with said control element, spring means for urging said second downwardly facing surface towards the first cam surfaces, and a rod opposite ends of which bear on said pistons to prevent the pistons moving towards one another, the spring means, by acting on the body of the second element, holding the pistons against movement away from the ends of the rod.

According to yet another aspect of the present invention there is provided a diffuser for controlling flow of air in an air conditioning system, the diffuser including an air flow control baffle, a first temperature sensitive element for sensing room temperature variations and including a body and a piston which move relatively to one another in response to temperature variations, a second temperature sensitive element for sensing duct temperature variations and including a body and a piston which move relatively to one another in response to temperature variations, a housing, the body of the second element being fixed to said housing, a pair of links having inner ends and outer ends, the links being pivotally mounted on said housing at their inner ends and having their outer ends connected to said baffle, the links protruding in opposite directions to one another from said housing, each link having a first cam surface on one side of its pivotal mounting and a second cam surface on the other side of its pivotal mounting, a control element having a first downwardly facing surface for bearing on said first cam surfaces and a second upwardly facing surface for bearing on said second cam surfaces, the body of the first temperature element being fast with said control element, spring means for urging said second upwardly facing surface towards the second cam surfaces, and a rod opposite ends of which bear on said pistons to prevent the pistons moving towards one another, the spring means, by acting on the body of the first element, holding the pistons against movement away from the ends of the rod.

BRIEF DESCRIPTION OF THE DRAWINGS

For a better understanding of the present invention, and to show how the same may be carried into effect, reference will now be made, by way of example, to the accompanying drawings in which.

DETAILED DESCRIPTION OF THE DRAWINGS

Figure 1:
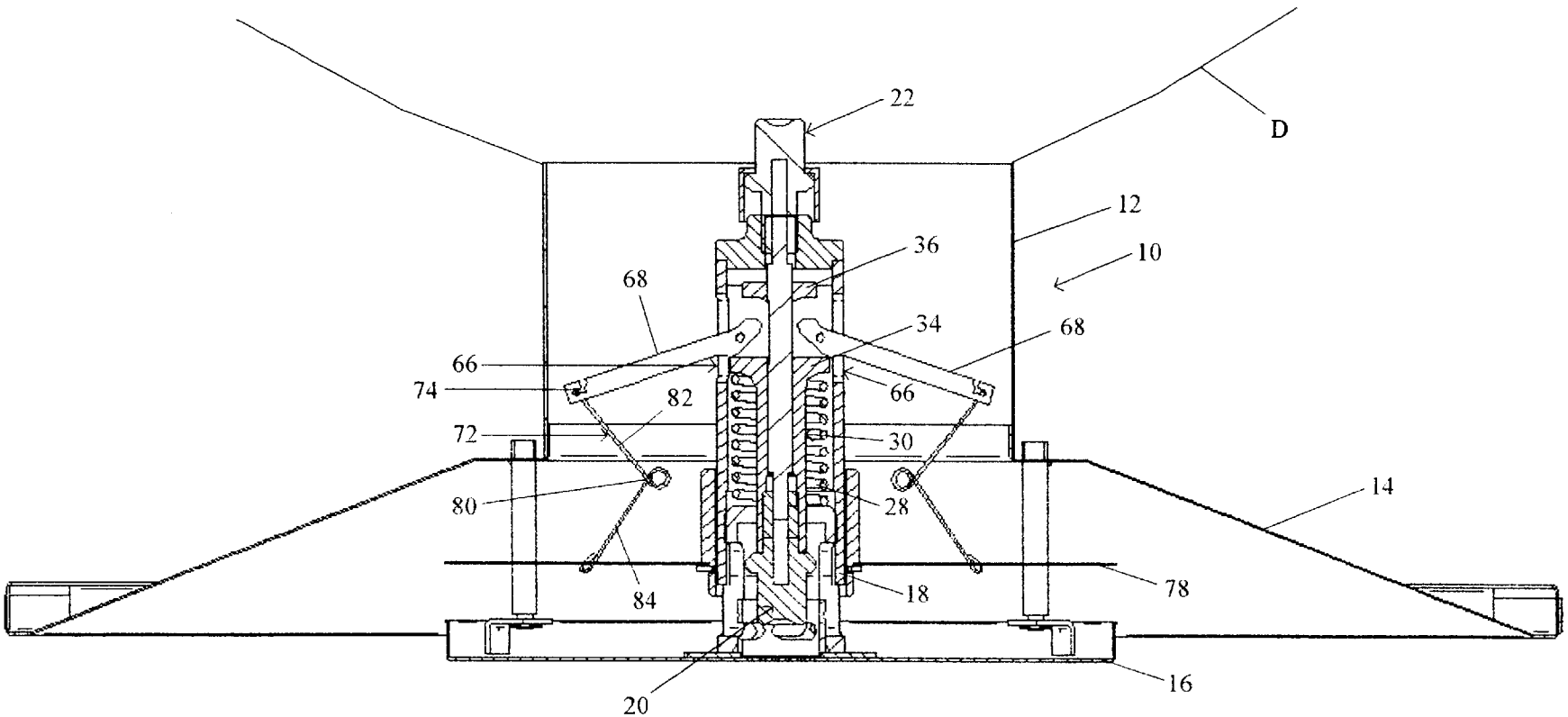
FIG. 1 is a vertical section through a diffuser in accordance with the present invention.

Referring firstly to FIG. 1 the diffuser 10 illustrated comprises a short vertical duct 12 which is connected at its upper end to the ducting D through which cooled air or heated air flows to the diffuser depending on the cooling or heating requirements which prevail. At the lower end of the duct 12 there is a truncated cone 14 which is mounted with its smaller end uppermost. At the wider lower end of the cone there is a trim disc 16 which conceals a vertically extending tube 18 which constitutes a housing of the diffuser 10. The trim disc 16 is constituted by a sheet of metal with an upturned rim. The lower end of the cone 14 is square or circular in shape and is bounded by a horizontal rim. This rim rests on the hangers (not shown) that are used to support the false ceiling in a building. The duct 12, ducting D and cone 14 are not shown in FIGS. 2 to 5.

The operating mechanism of the diffuser is shown in detail in FIGS. 2 to 5 and comprises two thermally sensitive elements 20, 22 which in the art are often referred to as "pills". Each element 20, 22 comprises a body 24 in which there is a wax that melts at a predetermined temperature and thereafter expands. One end of the body 24 is closed and the other end of the body 24 has an opening therein. Between the wax and the open end of the body there is a piston. The piston moves in the body 24 as the wax expands and contracts.

The trim disc 16 has slots in it to allow room air to enter the space above the trim disc 16 and circulate around the thermally sensitive element 20.

A rod 26 extends from the element 20 to the element 22, the ends of the rod 26 entering the bodies 24 via said openings. The ends of the rod 26 are in contact with the pistons. When the wax of either element expands it pushes the respective piston in the direction which moves more of the rod 26 out of the respective body 24. A spring 28 is provided for moving the rod 26 back into the bodies 24 when the wax contracts on cooling.

A one-piece bobbin 30 with a bore 32 passing therethrough is provided. The rod 26 passes through the bore 32. The bobbin 30 includes two discs 34 and 36. The discs 34 and 36 are spaced apart in the vertical direction. Below the disc 34 the bobbin is in the form of a vertically elongate sleeve 38 in the bore 32 of which the rod 26 slides. The lower portion of the bore 32 in the sleeve 38 is tapped and the upper end of the element 20 is screwed into the sleeve 38. The body 24 of the element 20 and sleeve 38 thus move together.

The bobbin and disc 34 and 36 form a control structure.

The lower end of the tube 18 is closed by an end cap designated 40. The cap 40 comprises a cylindrical side wall 42 which has an external step in it at 44. Above the step 44 the side wall has external threading 46 and the lower end of the tube 18 has corresponding internal threading. Below the step 44 the end cap has a ring of holes 48 in it to promote air flow over the element 20. The cap 40 is open at its lower end and has a transverse wall 50 at its upper end. The wall 50 has a central opening 52 through which the sleeve 38 passes with clearance.

The spring 28 is located between the transverse wall 50 of the cap 40 and the underside of the disc 34. One function of the spring 28 is to hold opposite ends of the rod 26 in contact with the pistons of the elements 20 and 22. In one constructional form the end sections of the rod 26 fit into the bodies 24 and there are shoulders between these sections and the remainder of the rod. The shoulders limit penetration of the rod into the bodies 24.

The discs 34 and 36 are connected by a column designated 54. In horizontal section the column 54 is rectangular, the bore 32 passing through the column 54.

The upper end of the tube 18 is closed by an end cap 56. The end cap 56 can be screwed into the tube 18, can be glued in or can be a push fit therein. The cap 56 has a vertically extending bore 58 therein which is tapped. The body 24 of the element 22 is screwed into the bore 58, the element protruding upwardly from the cap 56 into the ducting D.

A sleeve 60 is pressed over the upper end of the element 22 and conceals part of the body 24 of the element 22. By turning the element 22 with respect to the cap 56, the element 22 is displaced vertically thereby to adjust the set point of the diffuser.

The tube 18 has two diametrically opposed openings 66 therein. Two operating links 68 pass through the openings 66. The links 68 are pivotally mounted on the tube 18. The pivots consist of pins 70 spanning across the interior of the tube 18.

Hangers 72 (FIG. 1) are pivotally mounted at 74 on the outer ends of the links 68 and pass through holes 76 in an airflow control baffle 78. Each hanger 72 is in the form of a spring which is fabricated using resiliently flexible wire. As seen in FIG. 1, each hanger 72 has a central coil 80 and two arms 82 and 84. The hangers 72 pull the links 68 and baffle 78 towards one another.

The baffle 78 is disc-like and its periphery is close to the inner face of the cone 14 when the diffuser is closed (as shown in FIG. 1). The lower ends of the arms 84 of the hangers 72 pass through the baffle 78 and are bent over to form hooks which lie below the baffle 78. The baffle 78 rests on the hooks and is supported thereby.

Each link 68 has two cam surfaces. The first cam surface 86 of each link 68 is on the top edge of the link and co-operates with the underside of the disc 36. The second cam surface 88 of each link 68 is on the bottom edge of the link and co-operates with the top surface of the disc 34. The surfaces 86 are radially inwardly of the pivot pins 70 and the surfaces 88 are radially outwardly of the pins 70.

To inhibit heating or cooling of the element 20 by air entering the duct 12 from the ducting D, a sleeve (not shown) of thermally insulating material can be provided between the spring 28 and the sleeve 38.

Figure 2:
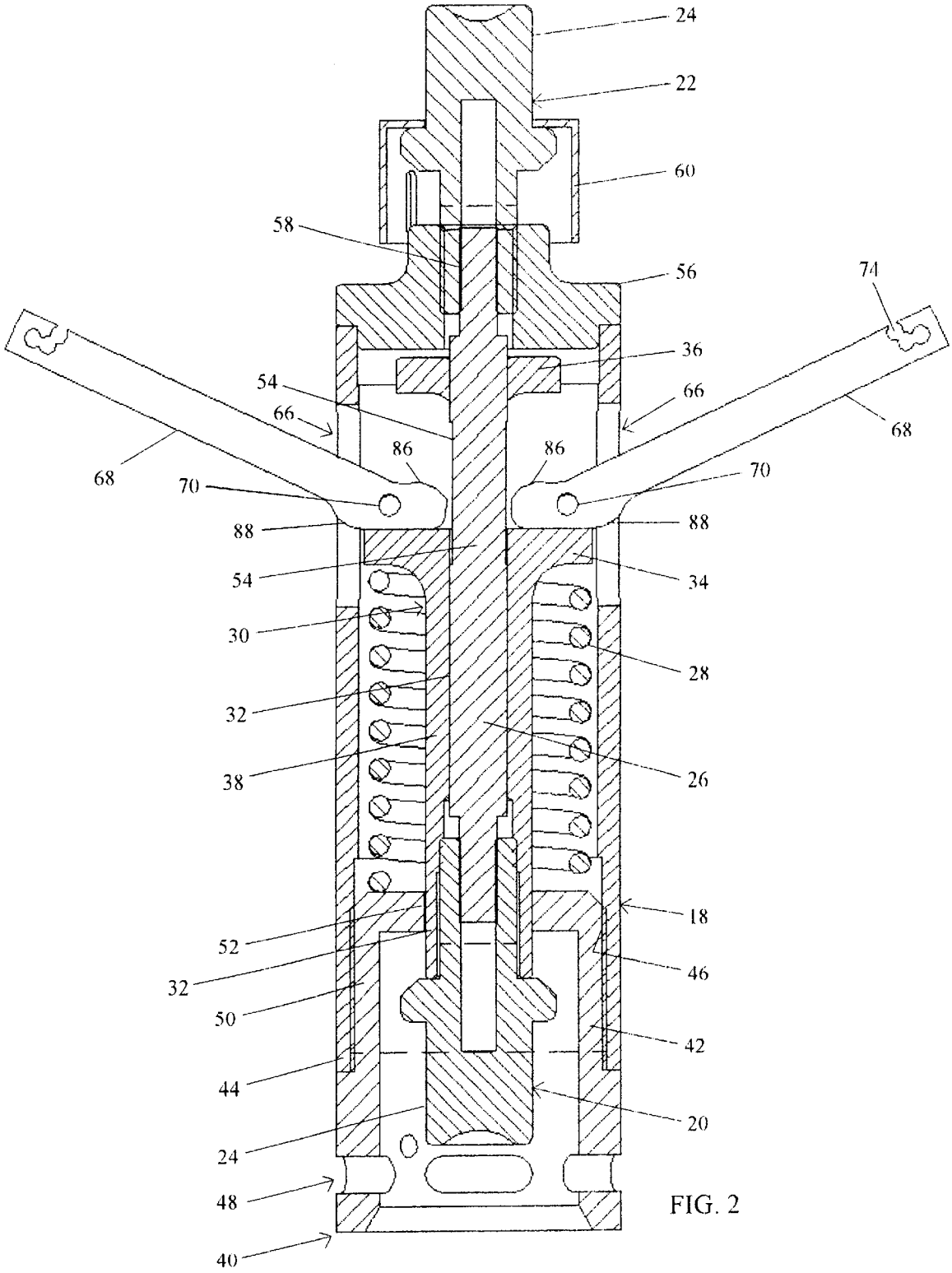
FIG. 2 is a vertical section through part of the diffuser of FIG. 1, FIG. 2 being to a larger scale than FIG. 1.

The element 20 senses room temperature and the element 22 detects duct temperature. On the assumption that cooled air is flowing in the ducting D, the piston of the element 22 is fully retracted. If it is further assumed that the room is cold, then the piston of the element 20 is also fully retracted, the wax in both elements 20 having contracted and possibly solidified. In these conditions the diffuser is as shown in FIG. 2. The spring 28 presses on the underside of the disc 34 lifting the bobbin 30 and element 20 upwardly with respect to the rod 26 to the maximum extent permitted by the structure.

The links 68 are thus in their fully raised positions which means that the baffle 78 is close to the cone 14 and air flow is at a minimum.

Figure 3:
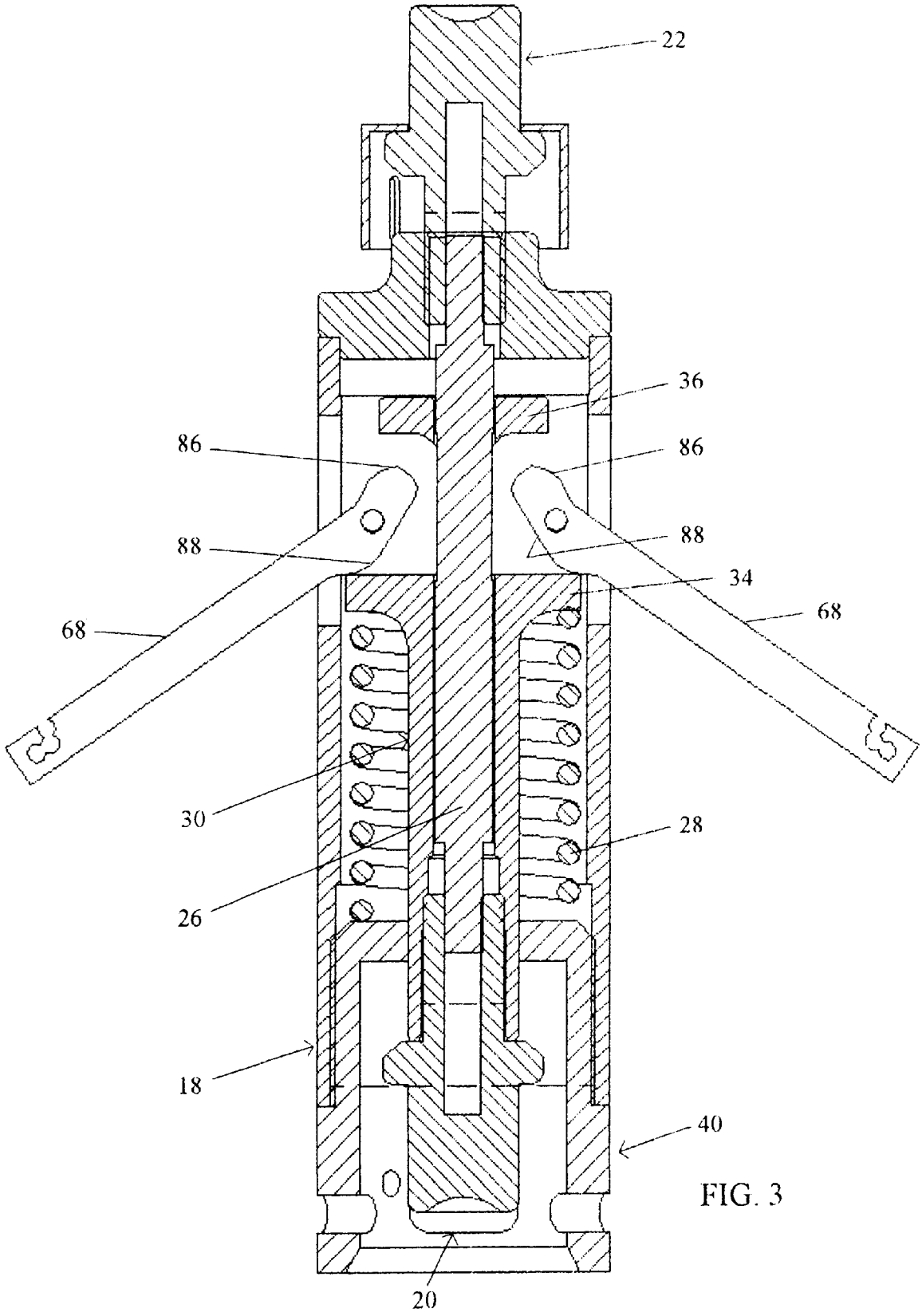
FIGS. 3 to 5 are vertical sections through the diffuser part of FIG. 2 and show the diffuser in different operative conditions.

As the room warms up, the wax in the element 20 expands and an upward thrust is exerted on the rod 26. However, the rod 26 cannot move upwardly as its upper end is against the piston of the element 22. Thus the body 24 of the element 20 moves downwardly with respect to the piston of that element. The bobbin 30 moves down with the body of the element 20. When the disc 34 descends, the links 68 pivot downwardly about the pins 70, the links 68 rolling on the cam surfaces 88. The baffle 78 is thus lowered and cold air can flow between the baffle 78 and the cone 14. This condition is shown in FIG. 3. The disc 34 thus constitutes a component which acts on the links whilst the element 22 is detecting cooled air.

As the element 20 cools the reverse action occurs, the bobbin 30 lifting with the body 24 of the element 20 as the wax contracts. The diffuser thus returns to the condition of FIG. 2 and flow of cold air ceases. Thus room temperature is regulated.

In cool or cold atmospheric conditions, heated air flows in the ducting D and the wax in the thermally sensitive element 22 expands. The piston of the element 22 moves downwardly pushing the rod 26 in the same direction.

Figure 4:
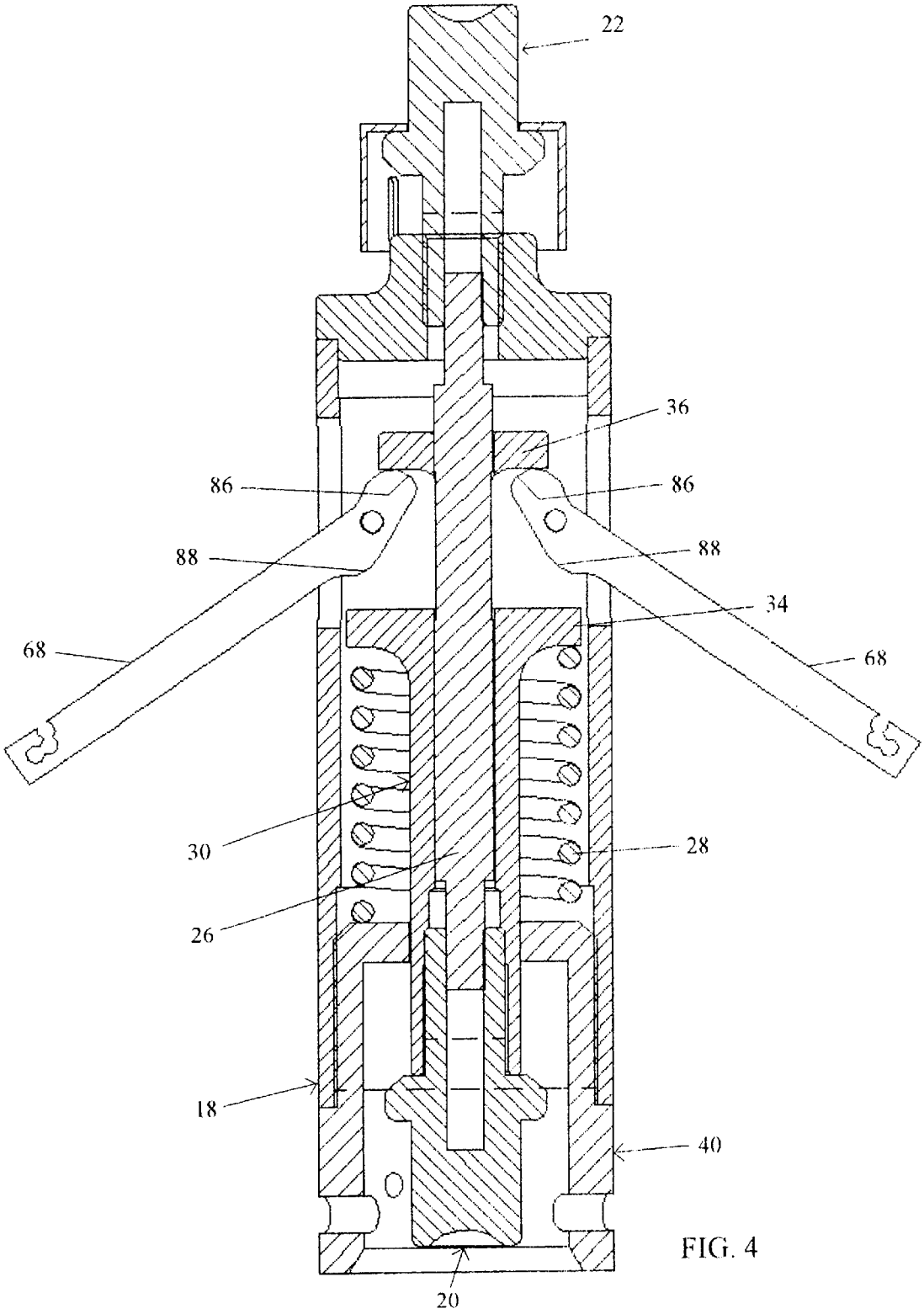
Figure 5:
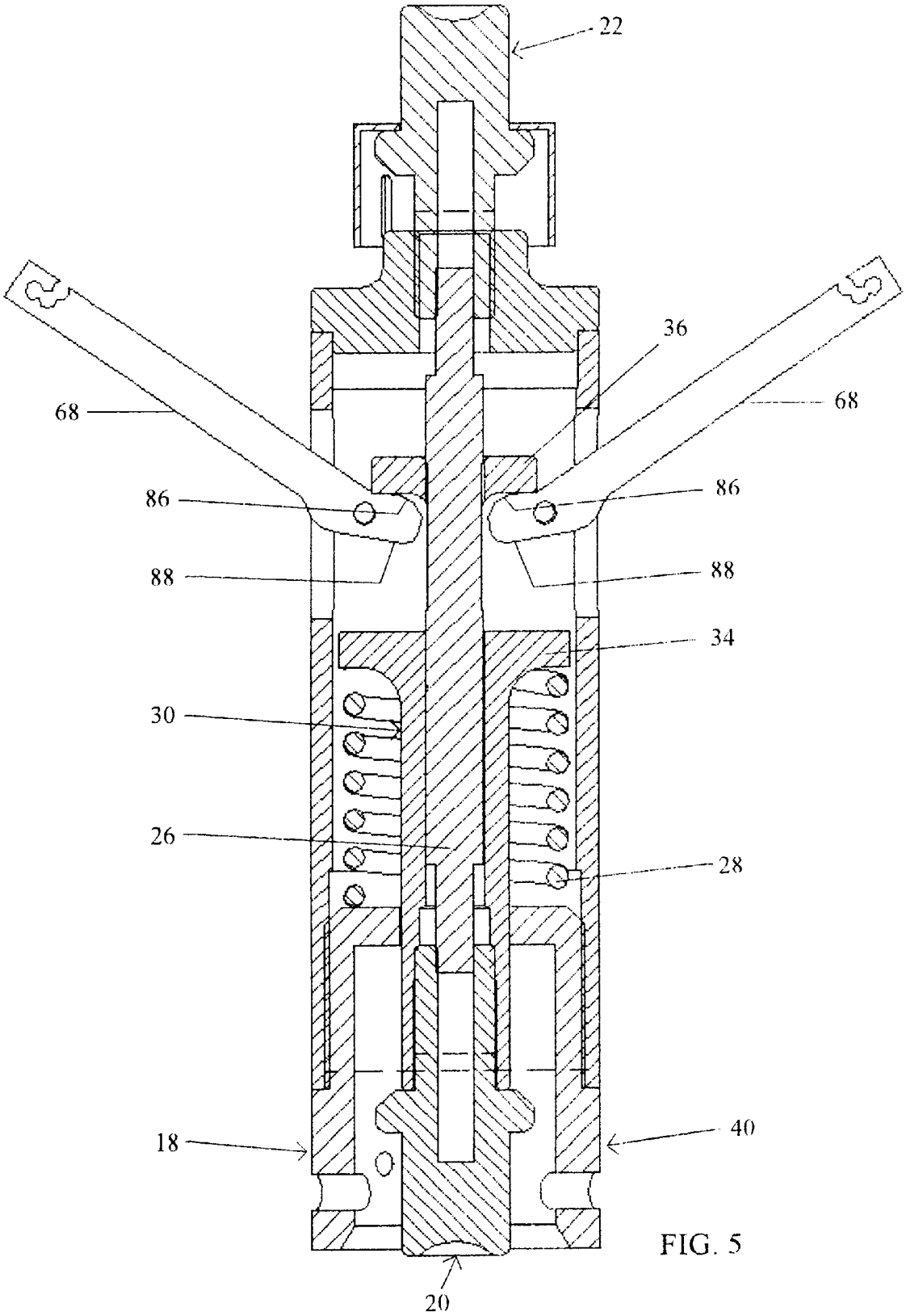

The lower end of the rod 26 pushes down on the piston of the element 20 shifting the entire element 20 and bobbin 30 downwardly. This is shown in FIGS. 4 and 5. FIG. 4 shows the position which the diffuser occupies when heated air is being supplied along the ducting D and the room is cold and FIG. 5 the position the diffuser occupies when heated air is being supplied and the room is warm.

It will be noted from FIG. 4 that the disc 34 has moved away from the links 68 and that the cam surfaces 88 are spaced from the disc 34. The cam surfaces 86 now co-operate with the underside of the disc 36.

As the element 20 heats up the wax in it expands and the piston is pushed in the direction which tends to move the rod 26 upwardly. However, the rod 26 is effectively fixed by the piston of the element 22 and thus the body of the element 20 moves down carrying the bobbin 30 with it. The disc 36 bears down on the cam surfaces 86 pivoting the outer ends of the links 68 upwardly. The baffle 78 is thus lifted towards the cone 14 reducing the supply of heated air. The links 68 are now as shown in FIG. 5 and the flow of heated air is a minimum. The disc 36 thus constitutes a second component which acts on the links whilst the element 22 is detecting warmed air.

As the room cools, the wax in the element 20 contracts. The piston thus tends to move downwards away from the lower end of the rod 26. However, the spring 28 acts on the piston through the disc 34, sleeve 38, the body 24 and the wax holding it against the lower end of the rod 26. The body C24 of the element 20 thus moves upwards against the spring action allowing the outer ends of the links 68 to pivot downwards about the pins 70, the links rolling on the cam surfaces 86. The diffuser is now again as shown in FIG. 4.

A change over from heated air in the duct 12 to cooled air causes the wax of the element 22 to contract bringing the disc 34 and cam surfaces 88 back into their co-operating relationship and separating the disc 36 and the cam surfaces 86.

Figure 6:
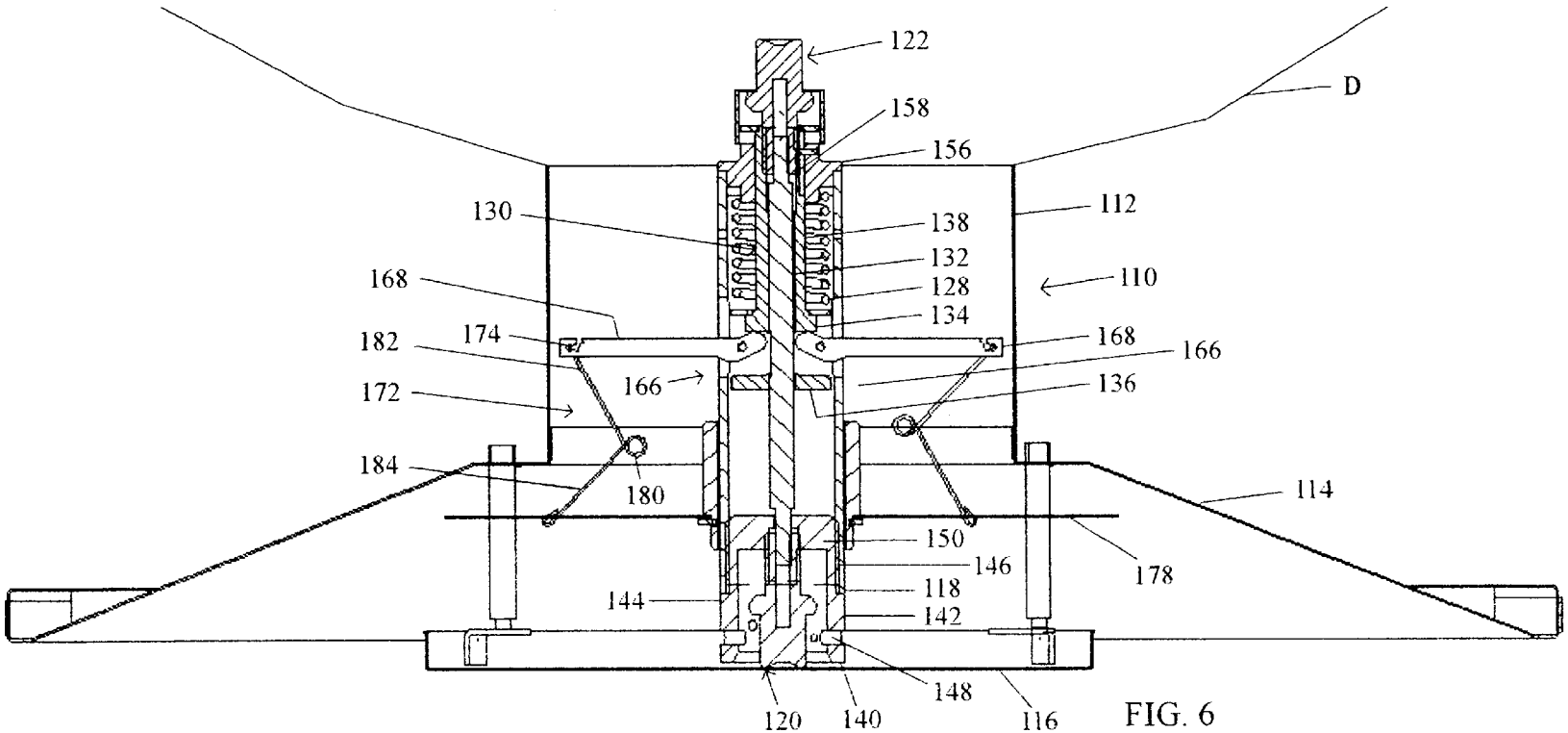
FIG. 6 is a vertical section through a second embodiment of the diffuser in accordance with the present invention.

Referring now to FIG. 6, a second embodiment of the diffuser is designated 110 and comprises a short vertical duct 112 which is connected at its upper end to the ducting D through which cooled air or heated air flows to the diffuser 110 depending on the cooling or heating requirements which prevail. At the lower end of the duct 112 there is a truncated cone 114 which is mounted with its smaller end uppermost. At the wider lower end of the cone 114 there is a trim disc 116 which conceals a vertically extending tube 118 of the diffuser 110. The trim disc 116 is constituted by a sheet of metal with an upturned rim. The lower end of the cone 114 is square or circular in shape and is bounded by a horizontal rim. This rim rests on the hangers (not shown) that are used to support the false ceiling in a building.

The operating mechanism of the diffuser 110 is shown in detail in FIGS. 7 to 10 and comprises two thermally sensitive elements 120, 122. The duct 112, ducting D and cone 114 are not shown in FIGS. 7 to 10.

The trim disc 116 has slots in it to allow room air to enter the space above the trim disc 116 and circulate around the thermally sensitive element 120.

A rod 126 extends from the element 120 to the element 122, the ends of the rod 126 entering the housings 124. The ends of the rod 126 are in contact with the pistons. When the wax of either element 120, 122 expands it pushes on the respective piston in the direction which moves more of the rod 126 out of the respective housing 124. A spring 128 is provided for moving the rod 126 back into the housings 124 when the wax contracts on cooling.

A one-piece bobbin 130 (see also FIG. 7) with a bore 132 passing therethrough is provided. The rod 126 passes through the bore 132. The bobbin 130 includes two discs 134 and 136. The discs 134 and 136 are spaced apart in the vertical direction. Above the disc 134 the bobbin 130 is in the form of a vertically elongate sleeve 138 in the bore 132 of which the rod 126 slides. The upper portion of the bore 132 in the sleeve 138 is tapped and the lower end of the body 124 of the element 122 is screwed into the sleeve 138. The body 124 of the element 122 and sleeve 138 thus move together.

The lower end of the tube 118 is closed by an end cap designated 140. The cap 140 comprises a cylindrical side wall 142 which has an external step in it at 144. Above the step 144 the side wall 142 has external threading 146 and the lower end of the tube 118 has corresponding internal threading. Below the step 144 the end cap 140 has a ring of holes 148 in it to promote air flow over the element 120. The cap 140 is open at its lower end and has a transverse wall 150 at its upper end. The wall 150 has a central opening 152 through which the rod 126 passes with clearance.

The upper end of the tube 118 is closed by an end cap 156. The end cap 156 can be screwed into the tube 118, can be glued into the tube or can be a push fit therein. The cap 156 has a vertically extending bore 158 therein. The sleeve 138 slides in the bore 158 of the cap 156.

A sleeve 160 is pressed over the upper end of the element 122 and conceals part of the body 124 of the element 122. By turning the element 122 with respect to the cap 156, the element 122 is displaced vertically thereby to adjust the set point of the diffuser 110.

The spring 128 is located between the end cap 156 and the upper surface of the disc 134. One function of the spring 128 is to hold opposite ends of the rod 126 in contact with the pistons of the elements 120 and 122. In one constructional form, the end sections of the rod 126 fit into the bodies 124 and there are shoulders between these sections and the remainder of the rod 126. The shoulders limit penetration of the rod 126 into the bodies 124.

The discs 134 and 136 are connected by a column designated 154. In horizontal section the column 154 is rectangular, the bore 132 passing through the column 154.

The tube 118 has two diametrically opposed openings 166 therein. Two operating links 168 pass through the openings 166. The links 168 are pivotally mounted on the tube 118. The pivots consist of pins 170 spanning across the interior of the tube 118.

Hangers 172 are pivotally mounted at 174 on the outer ends of the links 168 and pass through holes 176 in an airflow control baffle 178. Each hanger 172 is in the form of a spring which is fabricated using resiliently flexible wire. Each hanger 172 (see FIG. 6) has a central coil 180 and two arms 182 and 184. The hangers 172 pull the links 168 and baffle 178 towards one another.

The baffle 178 is disc-like and its periphery is close to the inner face of the cone 114 when the diffuser 110 is closed (as shown in FIG. 6). The lower ends of the arms 184 of the hangers 172 pass through the baffle 178 and are bent over to form hooks which lie below the baffle 178. The baffle 178 rests on the hooks and is supported thereby.

Each link 168 has two cam surfaces. The first cam surface 186 of each link 168 is on the top edge of the link 168 and co-operates with the underside of the disc 134. The second cam surface 188 of each link 168 is on the bottom edge of the link 168 and co-operates with the top surface of the disc 136. The surfaces 186 are radially inwardly of the pivot pins 170 and the surfaces 188 are radially outwardly of the pins 170.

To inhibit heating or cooling of the element 120 by air entering the duct 112 from the ducting D, a first sleeve of thermally insulating material 190 is provided above the element 120 and a second sleeve 192 is provided around the element 120.

Figure 7:
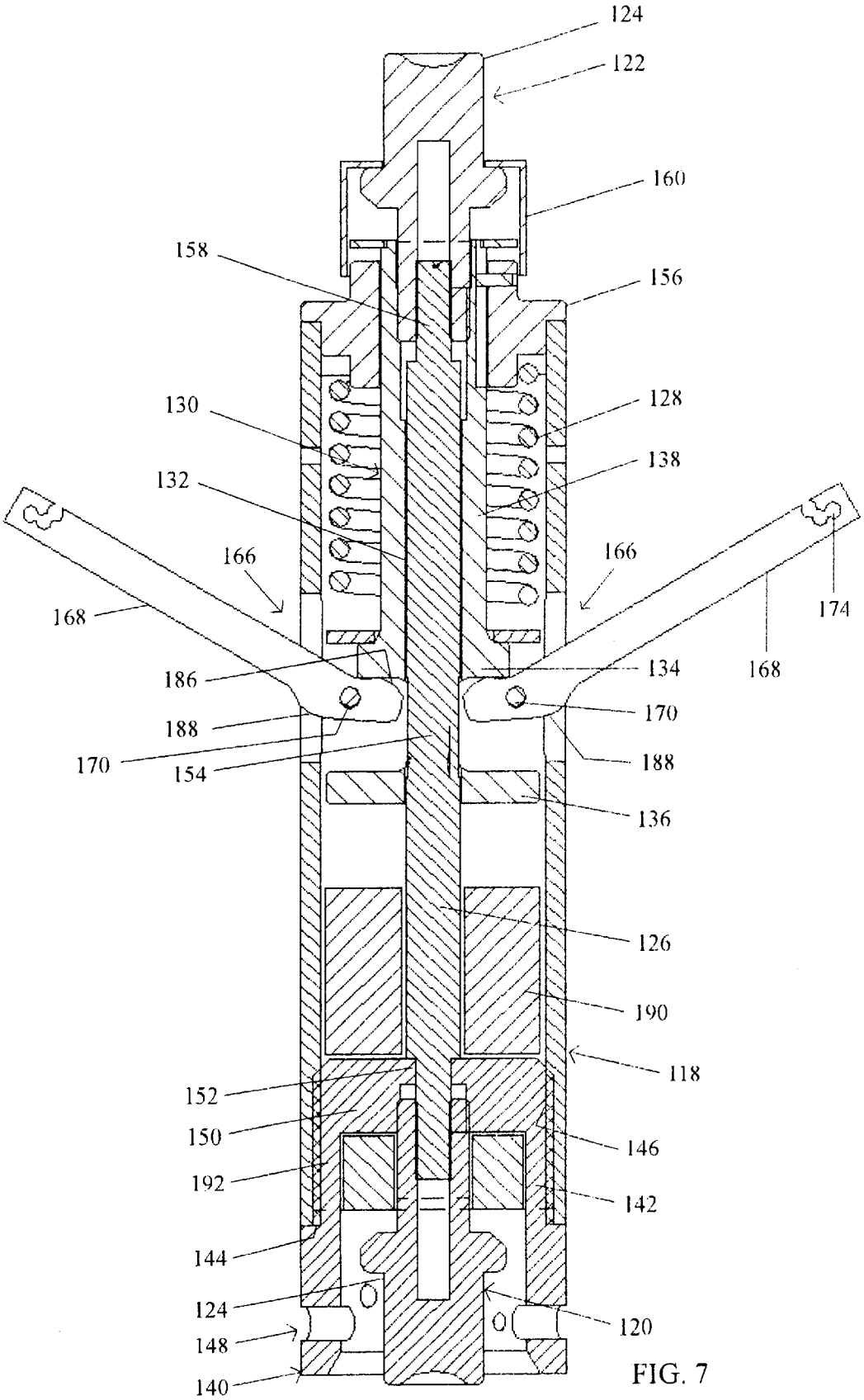
FIG. 7 is a vertical section through part of the diffuser of FIG. 6, FIG. 7 being to a larger scale than FIG. 6.

The element 120 senses room temperature and the element 122 detects duct temperature. On the assumption that cooled air is flowing in the ducting D, the piston of the element 122 is fully retracted. If it is further assumed that the room is cold, then the piston of the element 120 is also fully retracted, the wax in both elements 120 having contracted and possibly solidified. In these conditions the diffuser 110 is as shown in FIG. 7. The spring 128 presses on the upper surface of the disc 134 urging the bobbin 130 downwardly with respect to the rod 126 to the maximum extent permitted by the structure.

The disc 134 bears down on the cam surfaces 186 of the links 168 which are thus in their fully raised positions. This means that the baffle 178 is close to the cone 114 and air flow is at a minimum.

Figure 8:
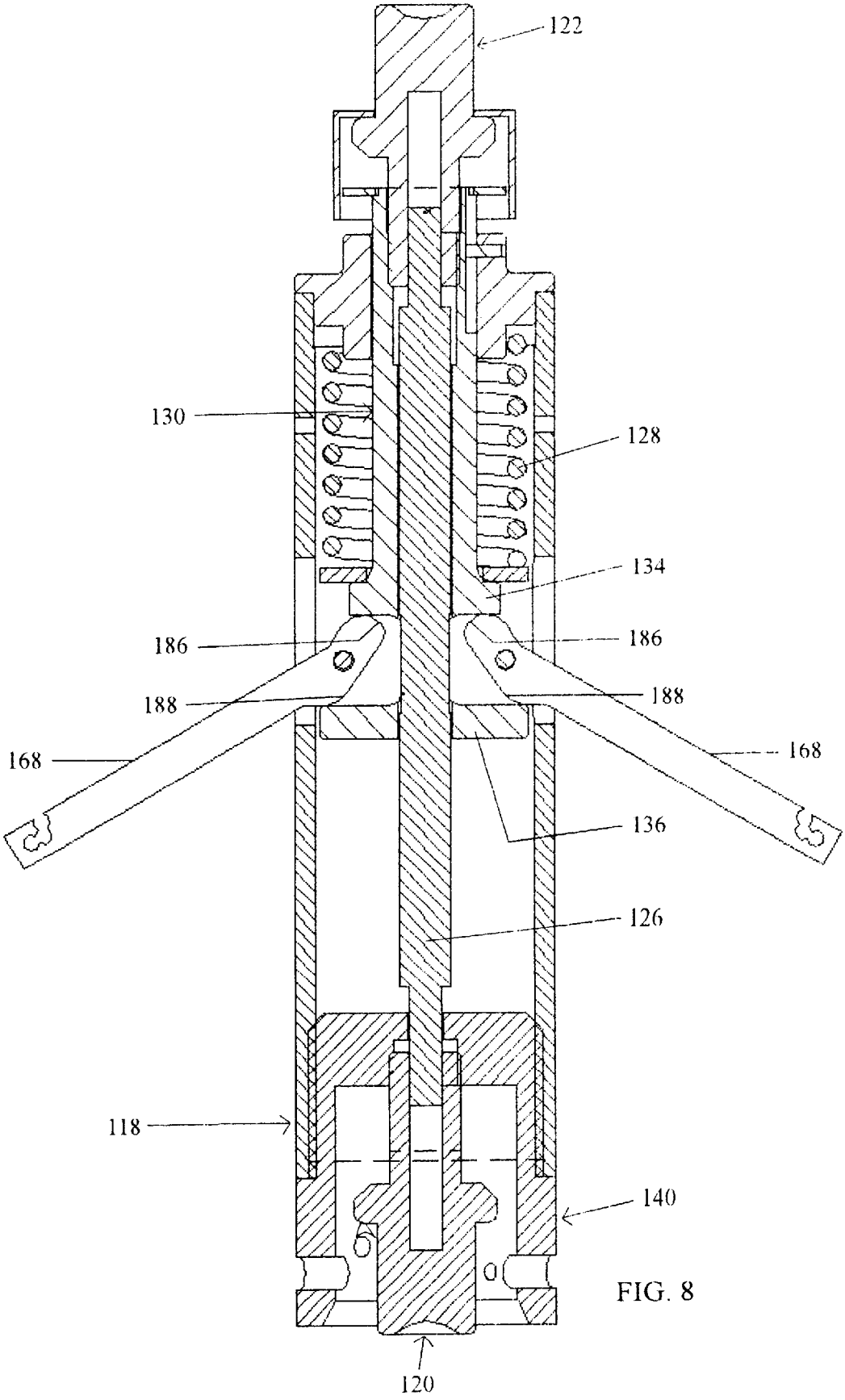
FIGS. 8 to 10 are vertical sections through the diffuser part of FIG. 7 and show the diffuser in different operative conditions.

As the room warms up, the wax in the element 120 expands and an upward thrust is exerted on the rod 126. The upper end of the rod 126 is against the piston of the element 122 and the piston of that element 122 cannot, because of the wax, move with respect to the body 124. Hence, the body 124 of the element 122 moves upwardly carrying the bobbin 130 up with it. When the disc 134 ascends, the links 168 pivot downwardly about the pins 170, the links 168 rolling on the cam surfaces 186. The baffle 178 is thus lowered and cold air can flow between the baffle 178 and the cone 114. This condition is shown in FIG. 8.

As the element 120 cools the reverse action occurs, the bobbin 130 descends with the body 124 of the element 122 as the wax contracts. The diffuser 110 thus returns to the condition of FIG. 7 and flow of cold air ceases. Thus room temperature is regulated.

Figure 9:
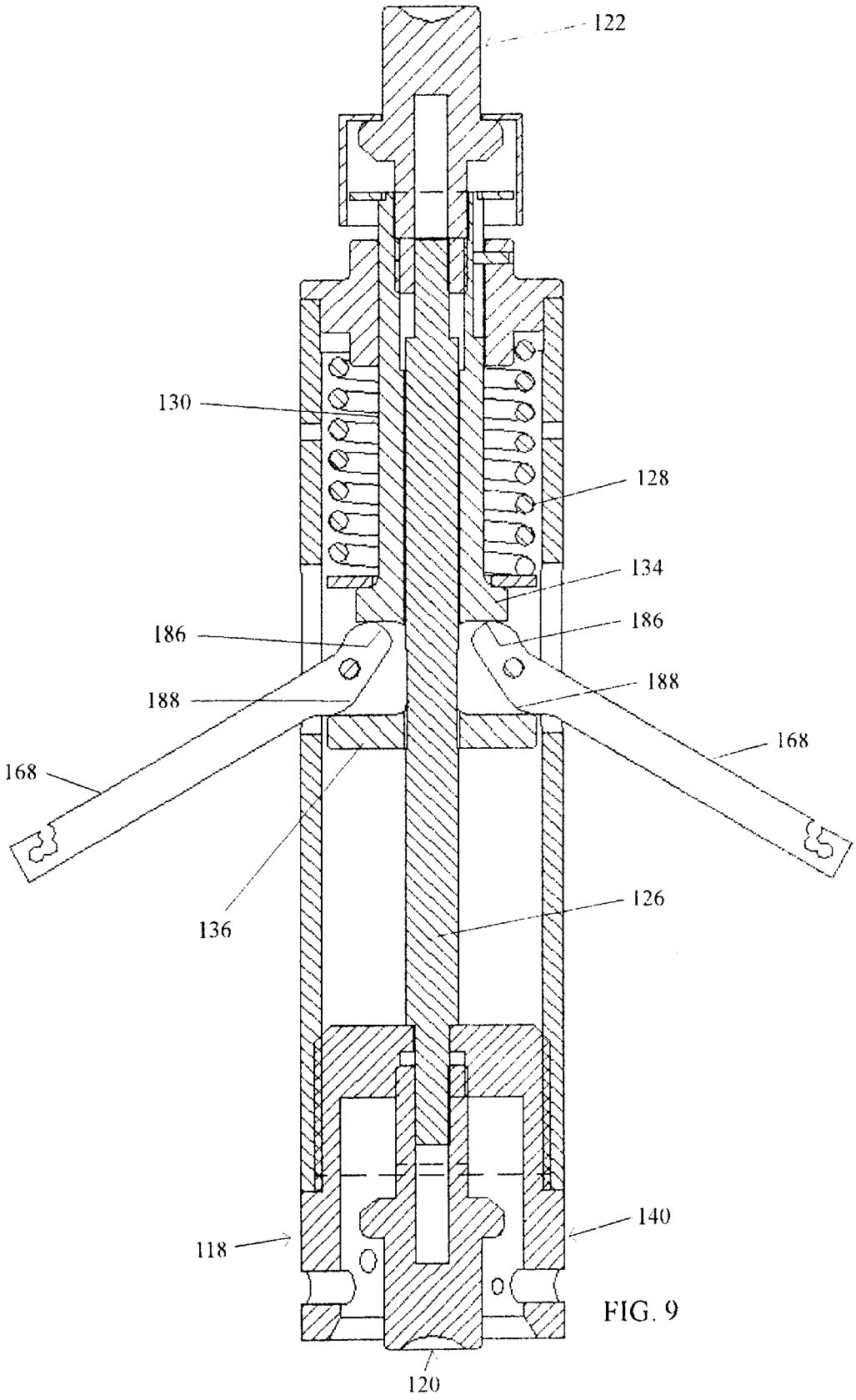

In cool or cold atmospheric conditions, heated air flows in the ducting D and the wax in the thermally sensitive element 122 expands. However, the rod 126 cannot move downwardly as its lower end is against the piston of the element 120. Thus the body 124 of the element 122 moves upwardly with respect to the piston of that element, carrying the bobbin 130 with it to the position shown in FIGS. 9 and 10. FIG. 9 shows the position which the diffuser 110 occupies when heated air is being supplied along the ducting D and the room is cold and FIG. 10 the position the diffuser 110 occupies when heated air is being supplied and the room is warm.

It will be noted from FIG. 9 that the disc 134 has moved away from the links 168 and that the cam surfaces 188 co-operate with the top face of the disc 136.

Figure 10:
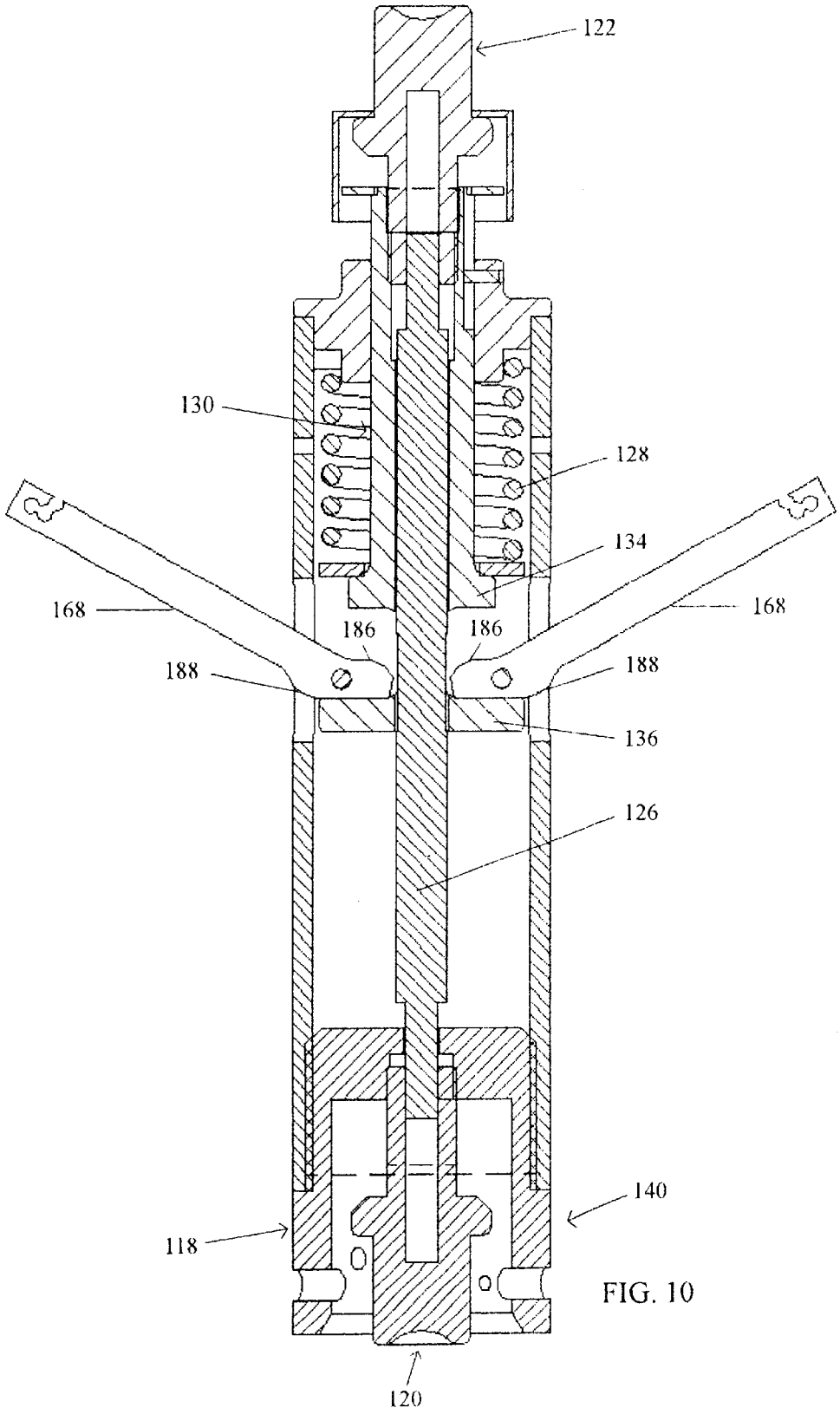

As the element 120 heats up the wax in it expands and its piston is pushed in the direction which tends to move the rod 126 upwardly. Thus the body of the element 120 moves up carrying the bobbin 130 with it. The disc 136 bears upwardly on the cam surfaces 188 pivoting the outer ends of the links 168 upwardly. The baffle 178 is thus lifted towards the cone 114 reducing the supply of heated air. The links 168 are now as shown in FIG. 10 and the flow of heated air is a minimum.

As the room cools, the wax in the element 120 contracts. Its piston thus tends to move downwards away from the lower end of the rod 126. However, the spring 128 bears down on the disc 134 forcing the bobbin 130 and the body of the element 122 downwardly so that the rod 126 follows the descending piston of the element 120. Downward movement of the disc 136 allows the outer ends of the links 168 to pivot downwards about the pins 170, the links 168 rolling on the cam surfaces 188. The diffuser 110 is now again as shown in FIG. 9.

A change over from heated air in the duct 112 to cooled air causes the wax of the element 122 to contract bringing the disc 136 and cam surfaces 188 back into their co-operating relationship and separating the disc 134 and the cam surfaces 186.

Turning now to FIGS. 11 to 16, these illustrate a modified form of the diffuser of FIGS. 6 to 10. Where applicable like parts have been designated with like reference numerals.

The end cap 140 is replaced by an end cap 140.1 which has a side wall 142.1 and an intermediate transverse wall 150.1. Above the wall 150.1 the end cap 140.1 has a short sleeve 194 which is internally threaded. The wall 142.1 and the sleeve 194 provide a well for receiving the sleeve 190 of thermally insulating material. The housing 124 of the element 122 is screwed into the sleeve 194 from below.

The bobbin 130.1 has a main section 196 which is internally tapped and into which the-housing 124 of the element 122 is screwed from above. It also has a smaller diameter lower section 198 which is externally threaded. The section 198 passes through a platform 200 and a nut 202 screwed onto the section 198 holds the platform 200 against the shoulder 204 which exists where the lower section 198 of the bobbin joins its main section 196.

The disc 134 of FIGS. 6 to 10 is placed by a disc designated 134.1 which includes an internally tapped collar 206. The disc 134.1 is screwed onto the section 198 below the nut 202. It is the lower end of the collar 206 which co-operates with the surfaces 186 of the links 168. The outer periphery of the disc 134.1 is knurled.

The rod designated 126.1 comprises an upper part 208 and a lower part 210. The part 208 is stepped down at its lower end to form a threaded spigot 212 which is screwed into a tapped blind bore 214 in the part 210.

The disc 136 is replaced by a disc 136.1 having an upstanding peripheral rim 216. The upper edge of the rim 216 co-operates with the cam surfaces 188 and the outer periphery of the rim 216 is knurled.

The end cap 156 is replaced by a disc-like top cap 218 which is held in place by a circlip 220. The spring 128 bears on the underside of the cap 218 and on the top surface of the platform 200.

By rotating the disc 134.1, it can be moved along the bobbin thereby to enable the cooling set point to be adjusted. Likewise, rotation of the disc 136.1 causes it to move along the bobbin thereby adjusting the heating set point.

A bracket 222 having a vertical section 224 (FIG. 16), and a horizontal section 226 (FIGS. 12 to 15) is provided. The section 226 has a hole in it through which the lower section of the bobbin passes, the section 226 being between the platform 200 and the nut 202. Thus the bracket 222 rises and falls with the bobbin.

The bracket section 226 protrudes from the tube 118 through a vertically elongate slot 228 so that the section 224 is outside the tube 118. The section 224 has two holes 230, 232 in it, the edges of the discs 134.1, 136.1 being visible through these holes. On the peripheries of these discs there are graduation marks which indicate set points. These marks can be seen through the holes 230, 232.

To enable access to be had to the discs 134.1, 136.1, openings are provided in the tube 118. These openings are not shown in FIGS. 11 to 16 but are illustrated in FIG. 17, and are designated 234, 236.

Figure 11:
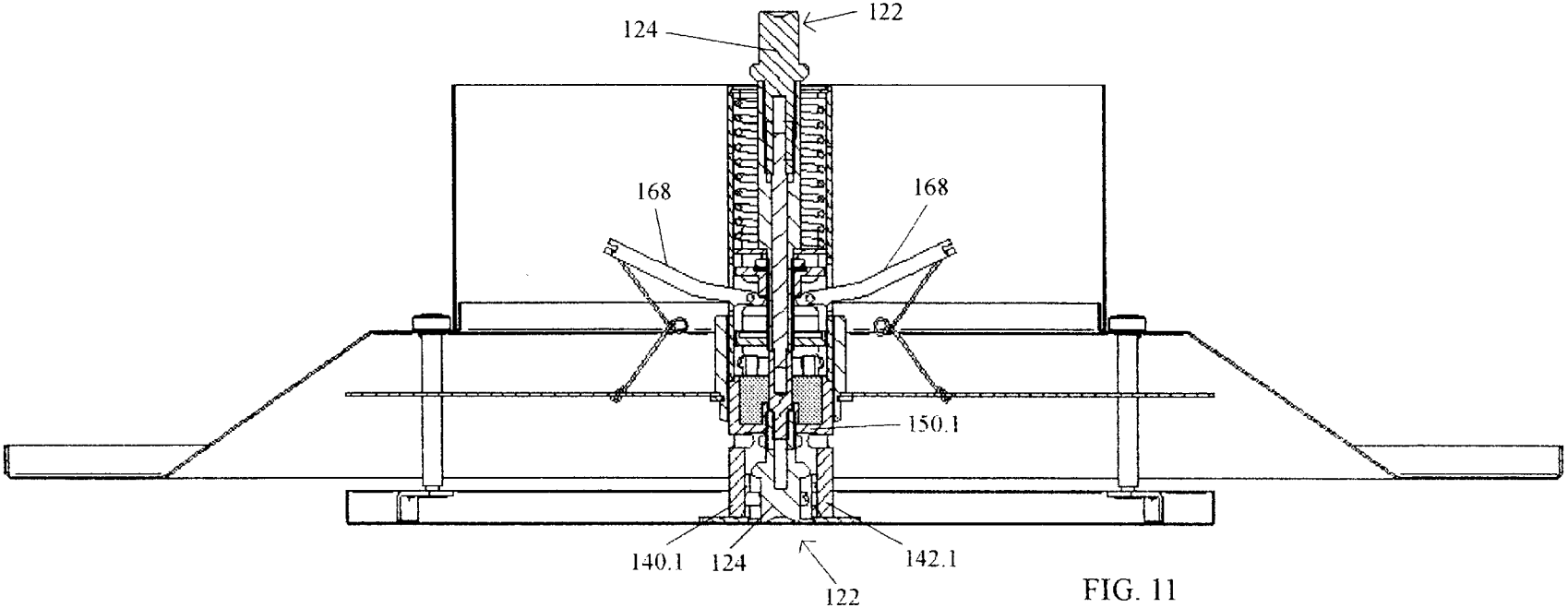
FIG. 11 is a vertical section through a third embodiment of the diffuser in accordance with the present invention.
Figure 12:
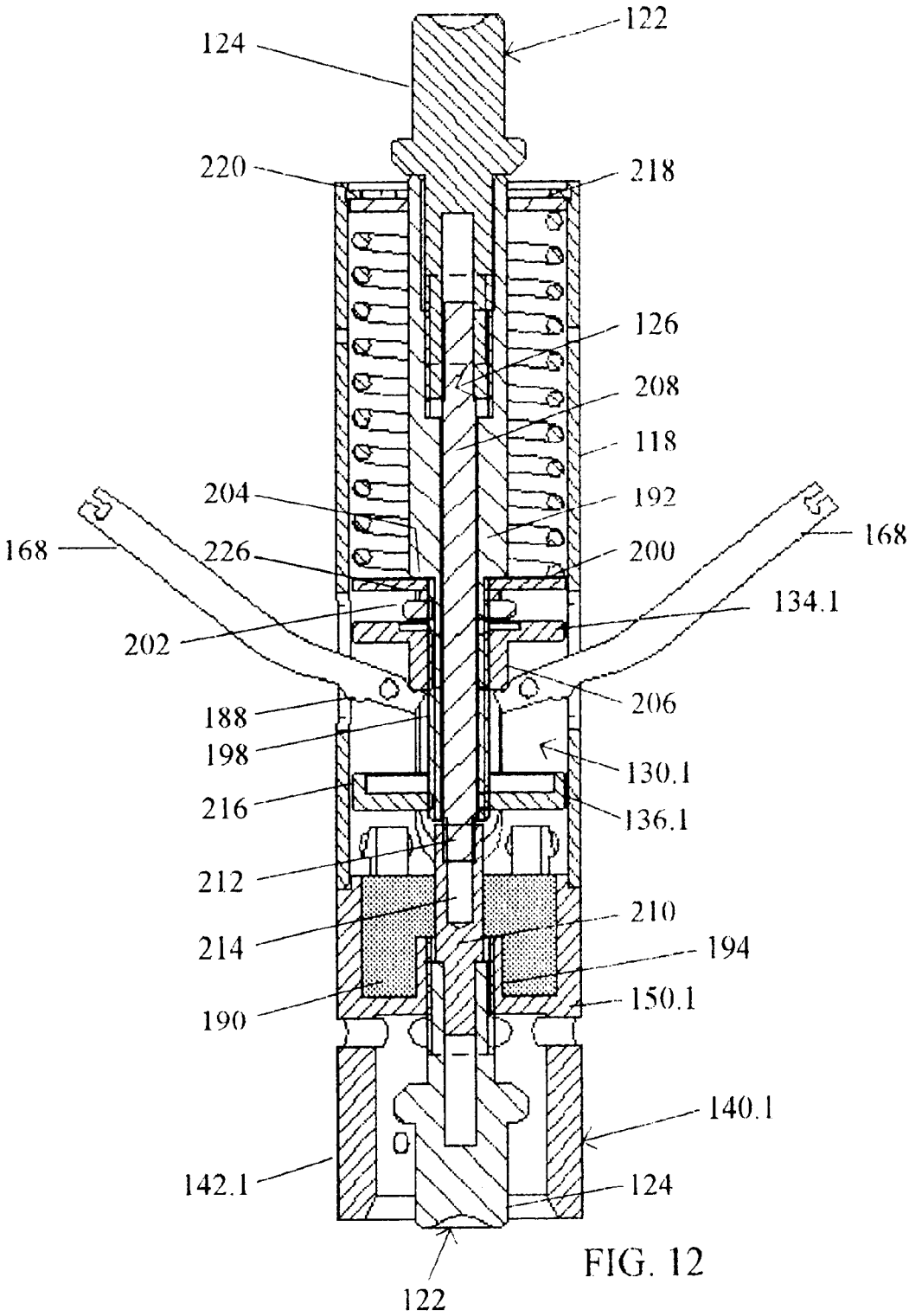
FIG. 12 is a vertical section through part of the diffuser of FIG. 11, FIG. 12 being to a larger scale than FIG. 11.
Figure 13:
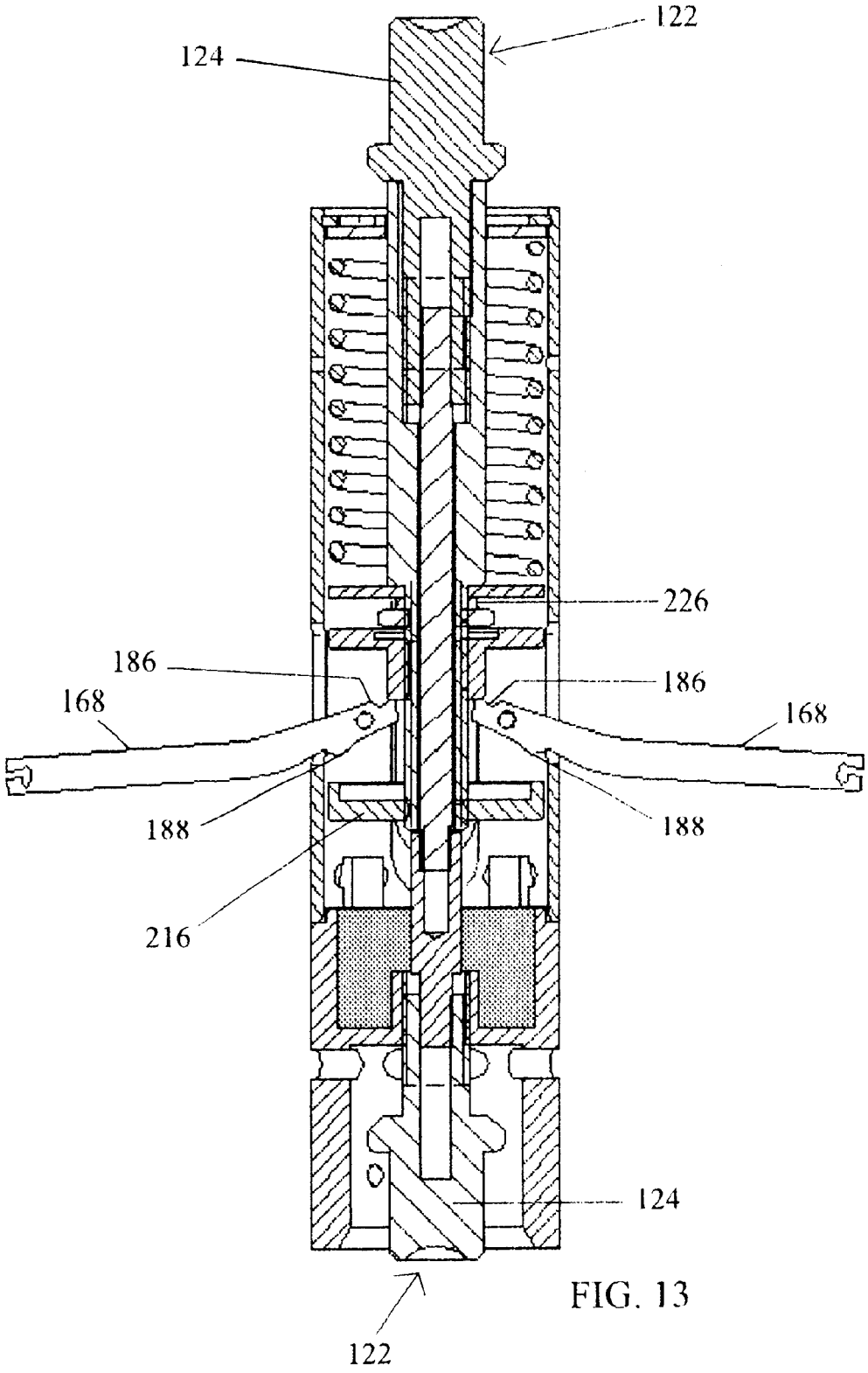
FIGS. 13 to 15 are vertical sections through the diffuser part of FIG. 12 and show the diffuser in different operative conditions.
Figure 14:
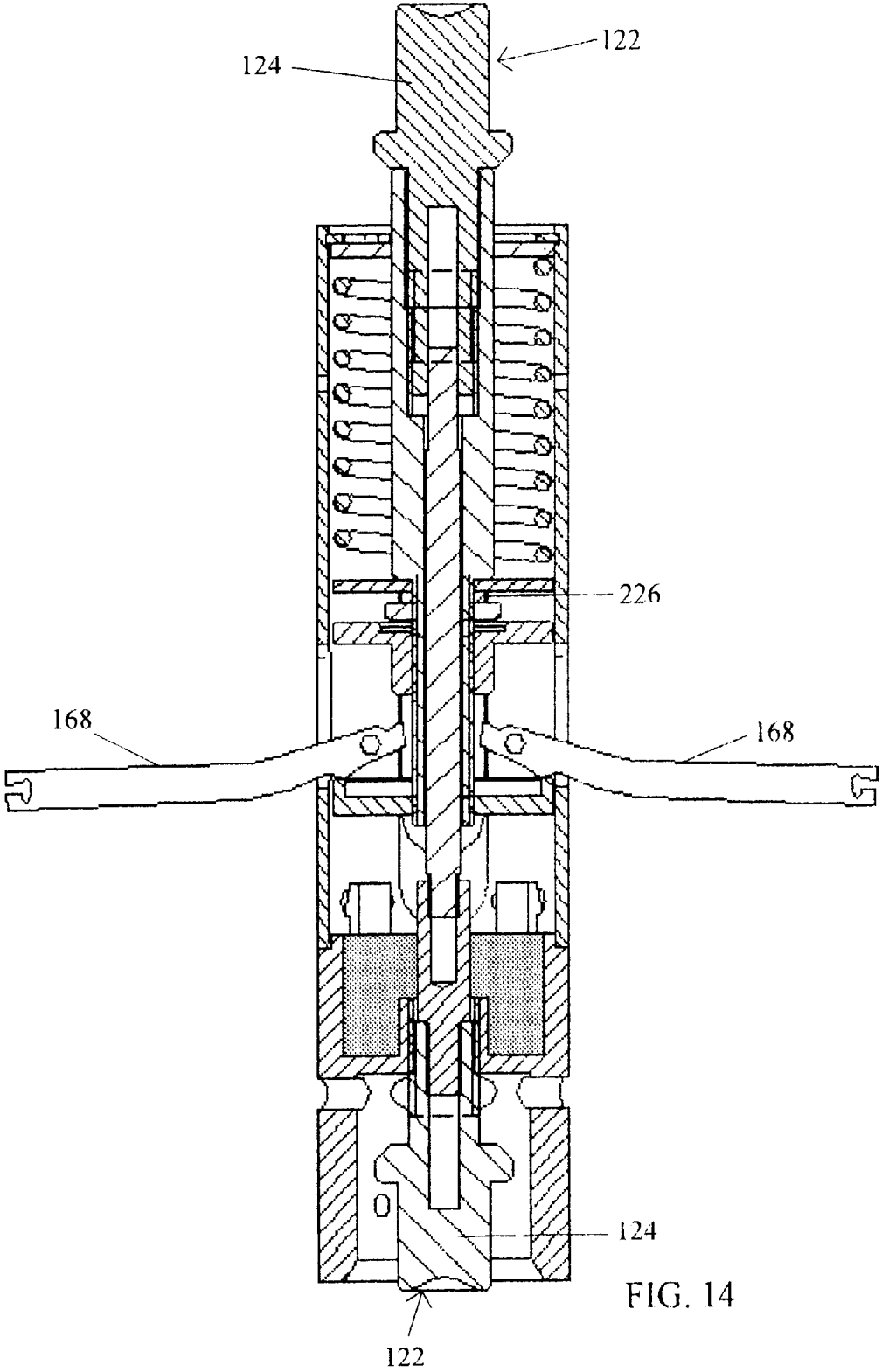
Figure 15:
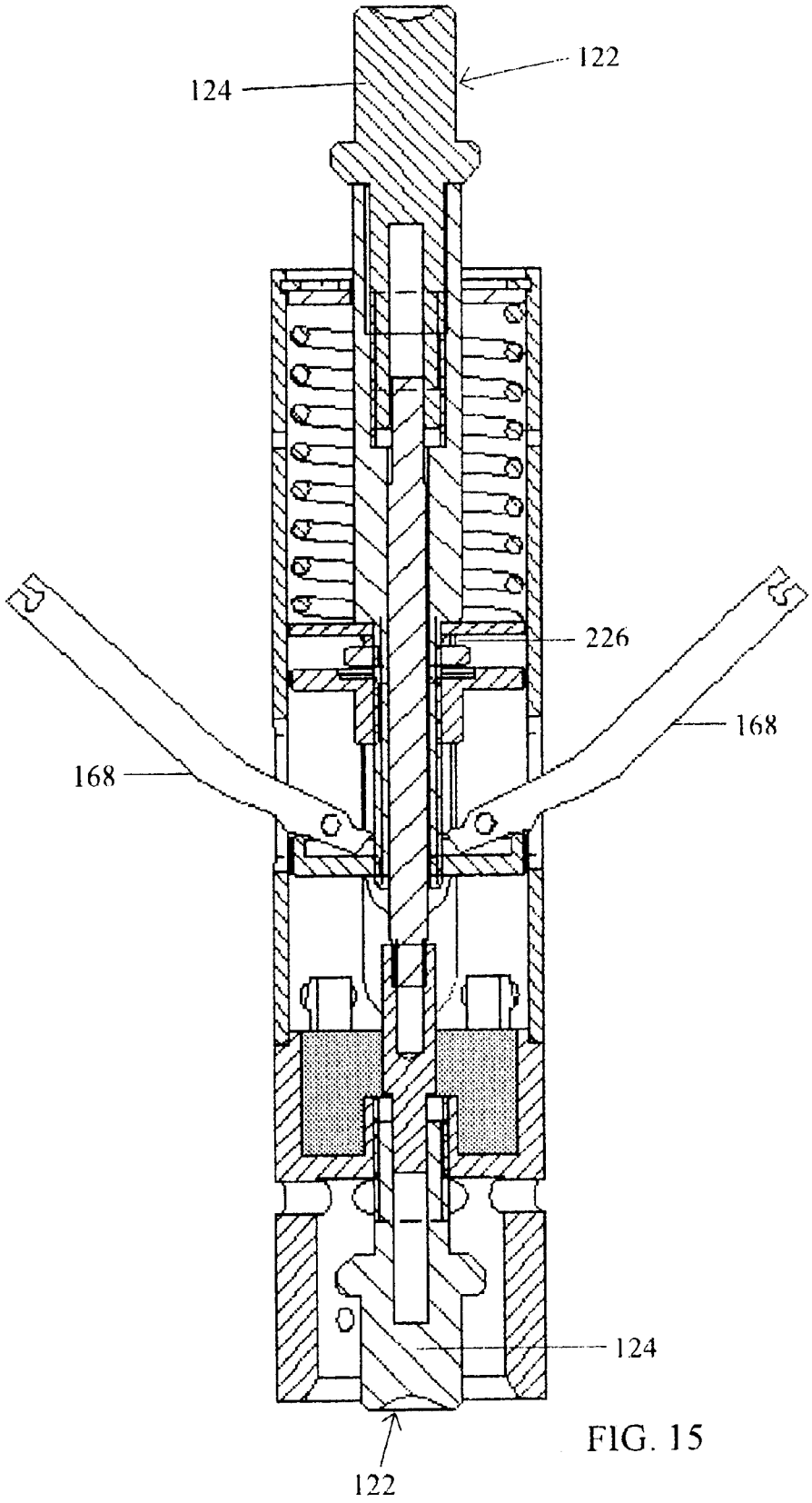
Figure 16:
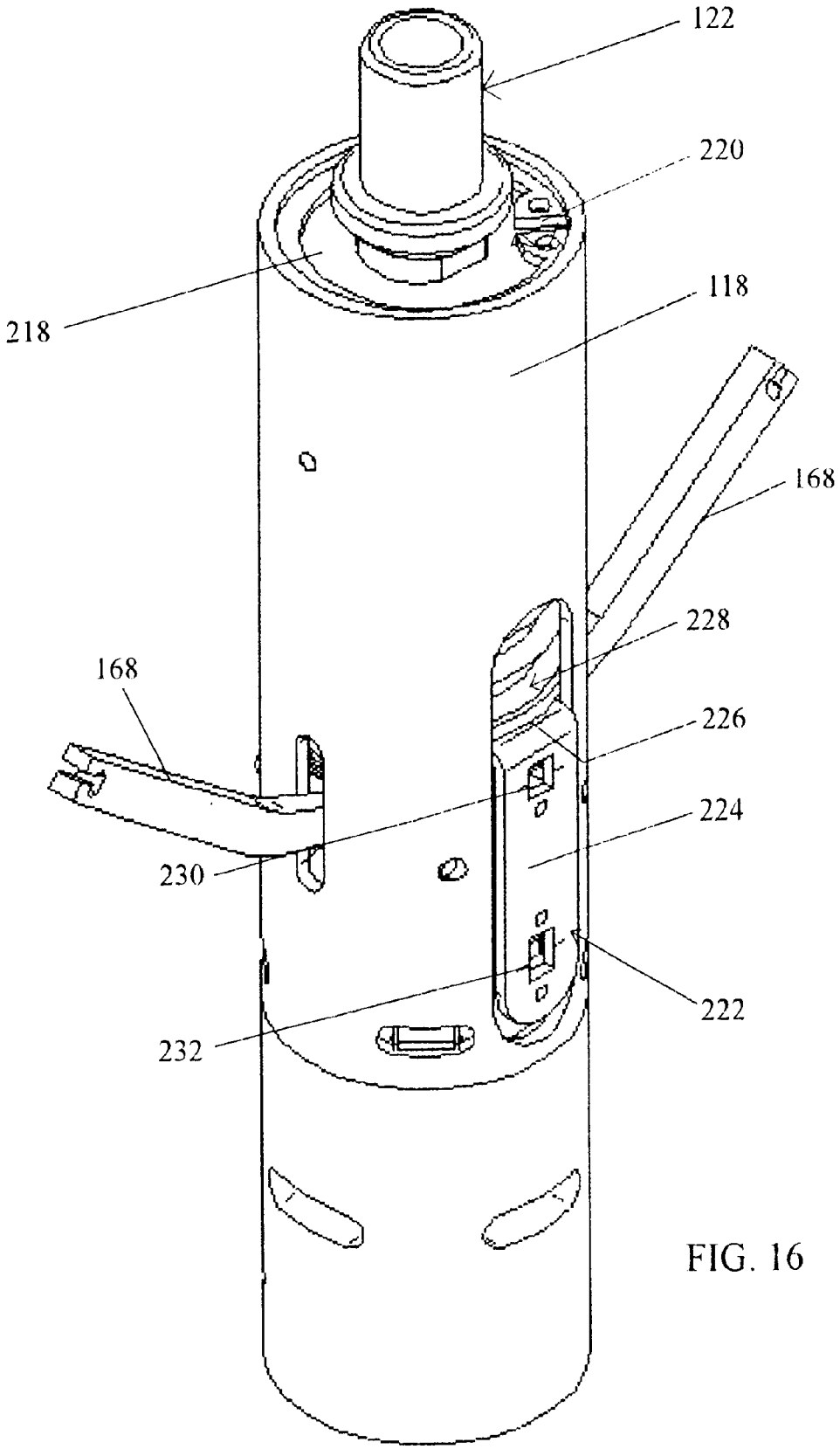
FIG. 16 is a pictorial view of the part of FIGS. 12 to 15.

The diffuser of FIG. 11 etc operates in the same way as the diffuser of FIGS. 6 to 10.

Figure 17:
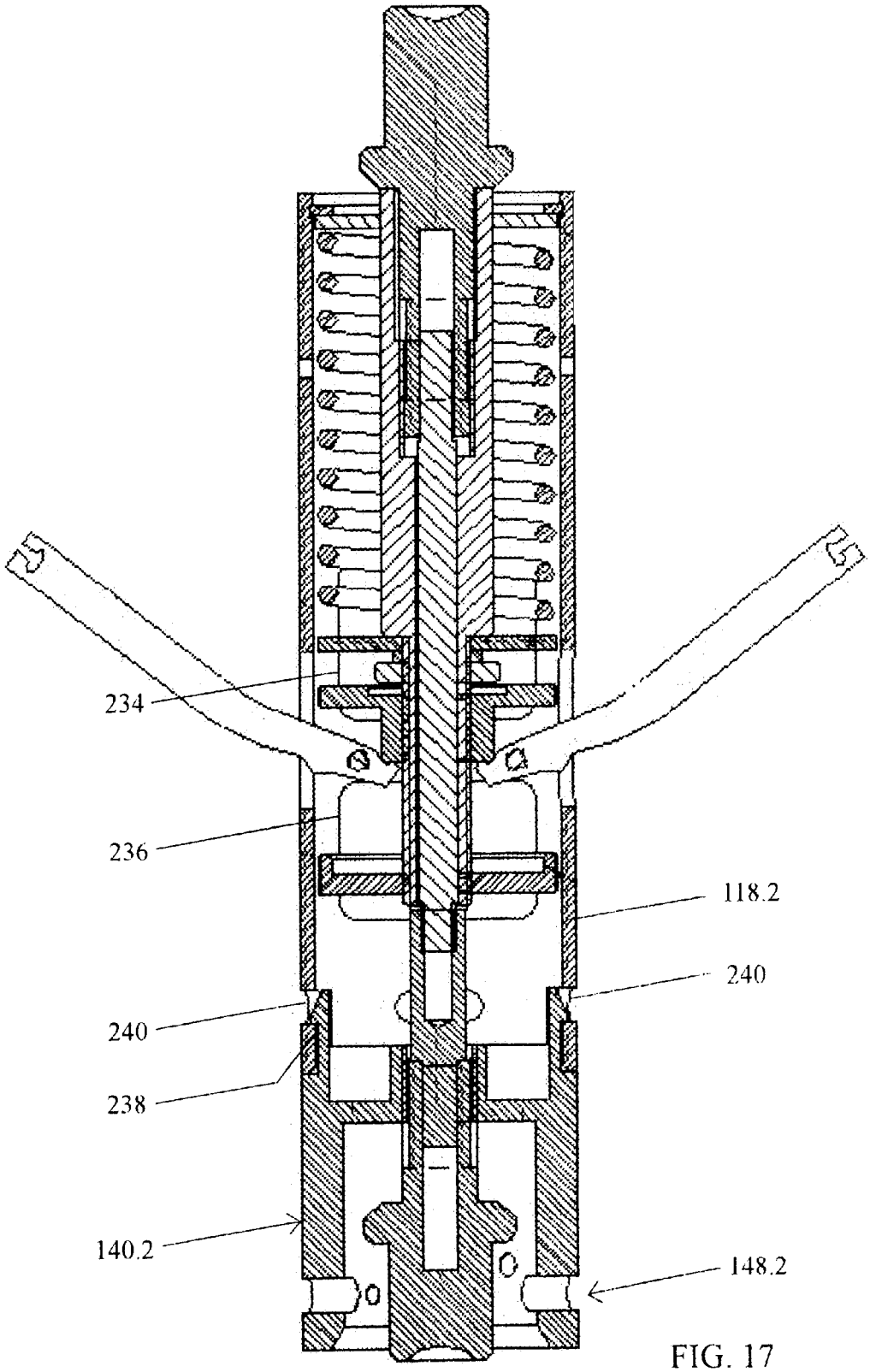
FIG. 17 is a section illustrating a modification of the diffuser part of FIGS. 12 to 16.

In FIG. 17 there is illustrated an arrangement in which the end cap 140.2 has a circumferential series of headed locking clips 238 around its upper end and the tube 118.2 has openings 240 for receiving these clips so that the end cap 140.2 "snap fits" onto the tube 118.2. The holes 148.1 of FIGS. 11 to 16 are replaced by holes 148.2 which are closer to the lower end of the end cap 140.2.

What is claimed is:

1. A diffuser for controlling flow of air in an air conditioning system, the said diffuser including:

an air flow control baffle, a first temperature sensitive element for sensing room temperature variations, said first temperature sensitive element including a body and a piston which move relatively to one another in response to temperature variations, a second temperature sensitive element for sensing duct temperature variations, said second temperature sensitive element including a body and a piston which move relatively to one another in response to temperature variations, a housing, a pair of links having inner ends and outer ends, the links being pivotally mounted on said housing at the inner ends and the links being connected to the baffle at the outer ends, the links protruding outwardly from said housing, each link having a respective first cam surface on one side of the pivotal mounting and a respective second cam surface on the other side of its pivotal mounting, a control element having a first surface for bearing on the first cam surfaces of the links and a second surface for bearing on the second cam surfaces of the links, spring means for urging the first surface of the control element towards the first cam surfaces of the links, and a rod having opposite ends bearing on the pistons of the temperature sensitive elements to prevent the pistons from moving towards one another, the body of one of the temperature sensitive elements being fixed to said housing and the body of the other temperature sensitive element being fast with said control element, said spring means acting on the body of the other temperature sensitive element and holding the pistons against movement away from the ends of the rod.

2. A diffuser for controlling flow of air in an air conditioning system, said diffuser comprising:

first and second temperature sensitive elements for respectively sensing temperature variations of the room and duct the temperature sensitive elements being axially aligned with one another, a link for displacing an air flow control baffle, and a control structure for displacing said link depending on the sensed room temperature by the first temperature sensitive element to displace said baffle and vary air flow, said control structure comprising a first component acting on the link when said second temperature sensitive element is detecting cooled air and a second component acting on the link when said second temperature sensitive element is detecting warmed air.

3. A diffuser for controlling flow of air in an air conditioning system, said diffuser including:

an air flow control baffle, a first temperature sensitive element for sensing room temperature variations, said first temperature sensitive element including a body and a piston moving relatively to one another in response to temperature variations, a second temperature sensitive element for sensing duct temperature variations and including a body and a piston moving relatively to one another in response to temperature variations, a housing, the body of the first temperature sensitive element being fixed to said housing, a pair of links comprising inner ends and outer ends, the links being pivotally mounted on said housing at the inner ends, and the links being connected to the baffle at the outer ends, the links protruding in opposite directions to one another from said housing, each link having a respective first cam surface on one side of the pivotal mounting and a respective second cam surface on the other side of the pivotal mounting, a control element having a first upwardly facing surface shaped for bearing on the second cam surfaces of the links and a second downwardly facing surface shaped for bearing on the first cam surfaces of the links, the body of the first temperature sensing element being fast with said control element, spring means for urging said second downwardly facing surface towards the first cam surfaces, and a rod having opposite ends bearing on the pistons of the temperature sensing elements to prevent the pistons from moving towards one another, said spring means acting on the body of the second temperature sensitive element and holding the pistons against movement away from the ends of the rod.

4. A diffuser for controlling flow of air in an air conditioning system, said diffuser including:

an air flow control baffle, a first temperature sensitive element for sensing room temperature variations, said first temperature sensitive element including a body and a piston moving relatively to one another in response to temperature variations, a second temperature sensitive element for sensing temperature variations of air inside the air conditioner and including a body and a piston moving relatively to one another in response to temperature variations, a housing, the body of the second element being fixed to said housing, a pair of links comprising inner ends and outer ends, the links being pivotally mounted on said housing at the inner ends, and the links being connected to the baffle at the outer ends, the links protruding in opposite directions to one another from said housing, each link having a respective first cam surface on one side of its pivotal mounting and a respective second cam surface on the other side of its pivotal mounting, a control element having a first downwardly facing surface for bearing on the first cam surfaces of the links and a second upwardly facing surface for bearing on the second cam surfaces of the links, the body of the first temperature sensing element being fast with said control element, spring means for urging said second upwardly facing surface towards the second cam surfaces, and a rod having opposite ends bearing on the pistons of the temperature sensing elements to prevent the pistons from moving towards one another, said spring means acting on the body of the first temperature sensitive element and holding the pistons against movement away from the ends of the rod.

5. The diffuser as claimed in claim 1, wherein said control element further comprises:

a bobbin fixed to the body of the other temperature sensitive element, a first disc having the first surface of the control element, a second disc having the second surface of the control element, the discs being threadably engaged with said bobbin such that positions of the first and second discs can be adjusted relative to one another and to the cam surfaces of the links to set a cooling set point and a heating set point by turning the discs.

6. The diffuser as claimed in claim 3, wherein said control element further comprises:

a bobbin fixed to the body of the other temperature sensitive element, a first disc having the first surface of the control element, a second disc having the second surface of the control element, the discs being threadably engaged with said bobbin such that positions of the first and second discs can be adjusted relative to one another and to the cam surfaces of the links to set a cooling set point and a heating set point by turning the discs.

7. The diffuser as claimed in claim 5, wherein said control element further comprises a bracket protruding from the housing, said bracket having openings to allow the adjustments to the discs.

8. The diffuser as claimed in claim 6, wherein said control element further comprises a bracket protruding from the housing, said bracket having openings to allow the adjustments to the discs.

9. The diffuser as claimed in claim 1, wherein said first and second temperature sensitive elements and said rod are positioned on a common axis.

10. The diffuser as claimed in claim 2, wherein said control structure further comprises a rod acting between the first and second temperature sensitive elements and axially aligned with said first and second temperature sensitive elements.

11. The diffuser as claimed in claim 3, wherein said first and second temperature sensitive elements and said rod are positioned on a common axis.

12. The diffuser as claimed in claim 4, wherein said first and second temperature sensitive elements and said rod are positioned on a common axis.

* * * * *

UNITED STATES PATENT AND TRADEMARK OFFICE

CERTIFICATE OF CORRECTION

PATENT NO. : 6,702,187 B2
DATED : March 9, 2004
INVENTOR(S) : Gustav Johan van der Merwe It is certified that error appears in the above-identified patent and that said Letters Patent is hereby corrected as shown below:

Title page,
Item [73], Assignee, "Richard" should read -- Rickard --.

Signed and Sealed this

Twenty-fifth Day of May, 2004

JON W. DUDAS
*Acting Director of the United States Patent and Trademark Office*